US008259021B2

(12) United States Patent
Pu et al.

(10) Patent No.: US 8,259,021 B2
(45) Date of Patent: Sep. 4, 2012

(54) ELECTROMAGNETIC RADIATION APPARATUS AND METHOD FOR FORMING THE SAME

(75) Inventors: Ta Chun Pu, Kaohsiung (TW); Chun Yih Wu, Taichung (TW); Hung Hsuan Lin, Taipei (TW); Jui Hung Chen, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 543 days.

(21) Appl. No.: 12/341,268

(22) Filed: Dec. 22, 2008

(65) Prior Publication Data

US 2010/0156738 A1 Jun. 24, 2010

(51) Int. Cl.
*H01Q 13/10* (2006.01)

(52) U.S. Cl. ..... 343/767; 343/702

(58) Field of Classification Search ..... 343/700 MS, 343/702, 846, 767

See application file for complete search history.

(56) References Cited

U.S. PATENT DOCUMENTS

| | | | | |
|---|---|---|---|---|
| 6,121,931 | A * | 9/2000 | Levi | 343/700 MS |
| 6,417,817 | B1 * | 7/2002 | Pirila et al. | 343/841 |
| 6,714,162 | B1 * | 3/2004 | Kadambi et al. | 343/700 MS |
| 6,812,902 | B2 * | 11/2004 | Rossman et al. | 343/725 |
| 6,992,627 | B1 * | 1/2006 | Honda et al. | 343/700 MS |
| 7,084,183 | B2 * | 8/2006 | Fuchs et al. | 522/36 |
| 7,439,910 | B2 * | 10/2008 | Lee | 343/700 MS |
| 7,764,242 | B2 * | 7/2010 | Milyakh | 343/752 |
| 2001/0052877 | A1 * | 12/2001 | Honda et al. | 343/702 |
| 2003/0146878 | A1 * | 8/2003 | Mikkola et al. | 343/702 |
| 2003/0210193 | A1 * | 11/2003 | Rossman et al. | 343/725 |
| 2004/0090385 | A1 * | 5/2004 | Green | 343/702 |
| 2007/0109196 | A1 | 5/2007 | Tang et al. | |
| 2009/0256757 | A1 * | 10/2009 | Chiang et al. | 343/702 |

* cited by examiner

*Primary Examiner* — Hoanganh Le
(74) *Attorney, Agent, or Firm* — WPAT, P.C.; Anthony King

(57) ABSTRACT

According to an embodiment of the present invention, an electromagnetic radiation apparatus includes a ground plane and an integrally formed antenna structure. The integrally formed antenna structure may include a radiation plate perpendicular to or with an angle larger than 45 degrees to the ground plane and a shielding structure configured to restrict radiation of the radiation plate.

20 Claims, 15 Drawing Sheets

ELECTROMAGNETIC RADIATION APPARATUS AND METHOD FOR FORMING THE SAME

BACKGROUND OF THE INVENTION (A) Field of the Invention

The present invention is related to an electromagnetic radiation apparatus and the method for forming the same, and more specifically to an electromagnetic radiation apparatus with a self-shielding antenna and the method for forming the same.

(B) Description of the Related Art

Wireless communication apparatuses generally include an antenna, a radio-frequency (RF) module and other electronic devices. To meet current demands of downsized products, the gap between the antenna and the components of the system is decreased, thus increasing the electromagnetic coupling effect. As a result, the radiation of the antenna is changed and the performance of the antenna is reduced. In addition, condensed circuitry layout also negatively influence antenna characteristics such as radiation pattern and return loss, so structural parameters need to be modified after integrating the antenna and the system to meet specifications of the initial design, increasing the design time and cost.

U.S. Publication No. 2007/0109196A disclosed an EMC (electromagnetic compatible) antenna having a shielding metal wall to effectively reduce the possible coupling with nearby electronic elements. However, the metal radiation metal of planar structure is parallel to the system ground plane and forms a three-dimensional structure that restricts the freedom of use and the type of radiation pattern.

In the rapidly developing market of handheld electronic apparatuses, small radiation apparatuses with less interference are highly demanded. Moreover, an electromagnetic radiation apparatus that could be applied to different electronic apparatuses such as PDAs, GPS, or notebook computers without further modification would provide high flexibility to a variety of applications.

SUMMARY OF THE INVENTION

The present invention provides an electromagnetic radiation apparatus and the method for forming the same, of which the gain and return loss are not affected by other devices in the system. The electromagnetic radiation apparatus can be applied to various apparatuses without further modifications of structural parameters. Moreover, the electromagnetic radiation apparatus provides the function to isolate the interference noises.

According to an aspect of the present invention, an electromagnetic radiation apparatus includes a ground plane and an integrally formed antenna structure. The integrally formed antenna structure may include a radiation plate perpendicular to or with an angle larger than 45 degrees to the ground plane and a shielding structure configured to restrict the radiation of the radiation plate.

According to another aspect of the present invention, a method of forming an electromagnetic radiation apparatus having an antenna is proposed. The antenna has a radiation plate and a shielding structure. The method includes the steps of: (a) selecting bending manners of the radiation plate and the shielding structure according to requirements of system spatial arrangement and radiation pattern; (b) determining a resonance length of the antenna according to operation frequency; (c) determining an initial shape of the antenna according to dimension, operation frequency and bandwidth of the radiation plate; (d) adjusting a position of a feeding point of the radiation plate and widths of the antenna so as to achieve impendence matching within operation band; and (e) selecting a gap between the shielding structure and the radiation plate with optimal gain and bandwidth.

DETAILED DESCRIPTION OF THE INVENTION

The present invention will be explained with the appended drawings to clearly disclose the technical characteristics of the present invention.

Figure 1A:
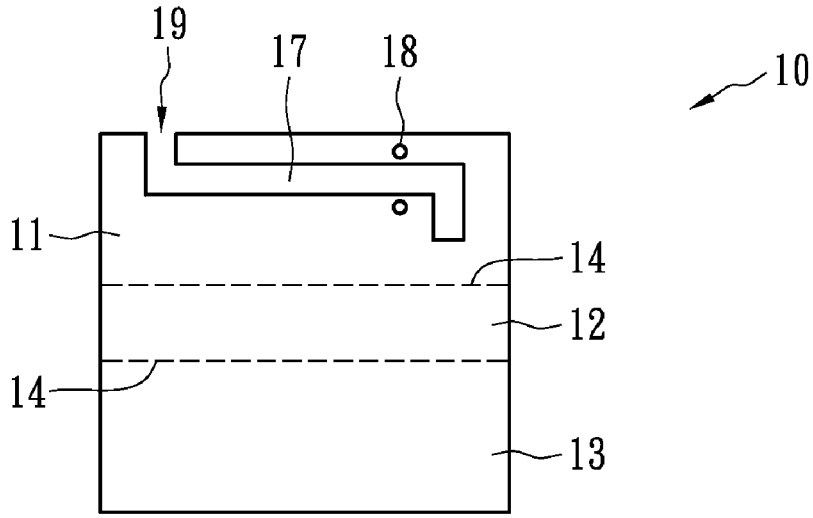
FIG. 1A shows a self-shielding antenna in accordance with an embodiment of the present invention.
Figure 1B:
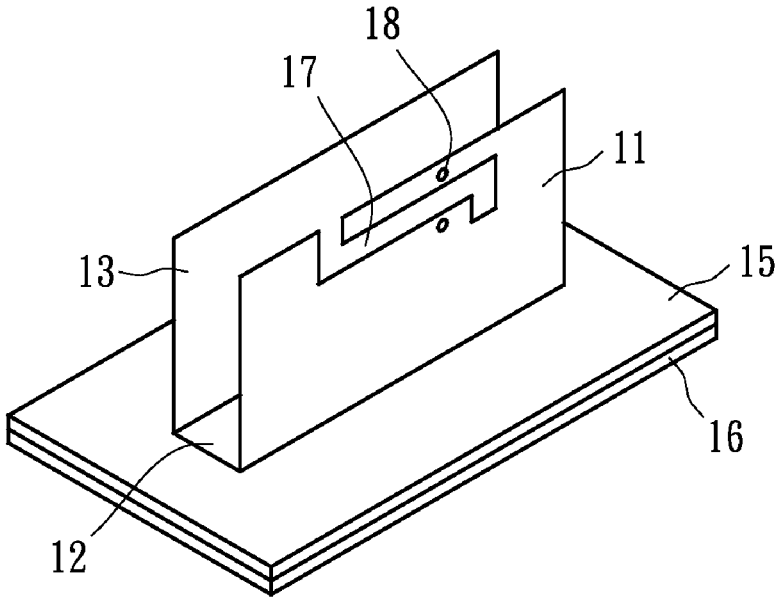
FIGS. 1B and 1D show electromagnetic radiation apparatuses in accordance with the present invention.
Figure 1C:
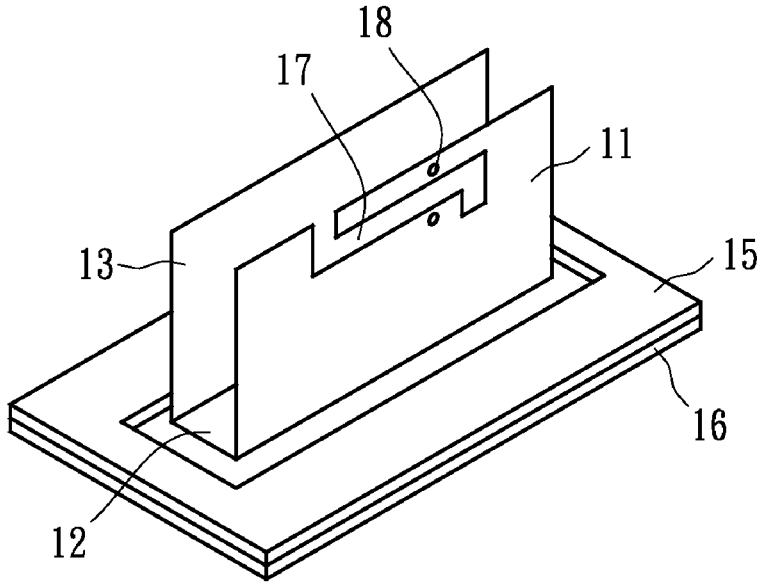

FIGS. 1A to 1C show an electromagnetic radiation apparatus having a self-shielding antenna in accordance with an embodiment of the present invention. An electromagnetic radiation apparatus 5 includes an antenna 10 and a ground plane 15. The antenna 10 is integrally formed, e.g., the antenna 10 is formed of a plate which has been subjected to bending, and the antenna 10 includes a radiation plate 11, a shielding plate 12 and a shielding plate 13. The shielding plate 12 and the shielding plate 13 form a shielding structure. The antenna 10 is bent according to two folds 14 to be a three-dimensional structure. The ground plane 15 is placed on a circuit board 16 (e.g., FR-4 board), and in an embodiment the shielding plate 12 contacts the ground plane 15 as shown in FIG. 1B. Alternatively, the shielding plate 12 does not contact the ground plane 15 and instead contacts the circuit board 16 directly as shown in FIG. 1C. The radiation plate 11 is perpendicular to the ground plane 15, and the shielding plate 13 is also perpendicular to and electrically connected to the ground plane 15 for restricting the radiation of the radiation plate 11. The radiation plate 11 has a slot 17 and a signal feeding device (radiation device) 18 including a positive electrode and a negative electrode placed at two sides of the slot 17 for operating differential signals. The slot 17 has an opening 19, and the length of the slot 17 is approximately ¼ of the length of the radiation electromagnetic wave of the antenna 10. In this embodiment, the longitudinal direction of the slot 17 is parallel to the ground plane 15. The shielding plate 13 is equal to or larger than the radiation plate 11.

Figure 1D:
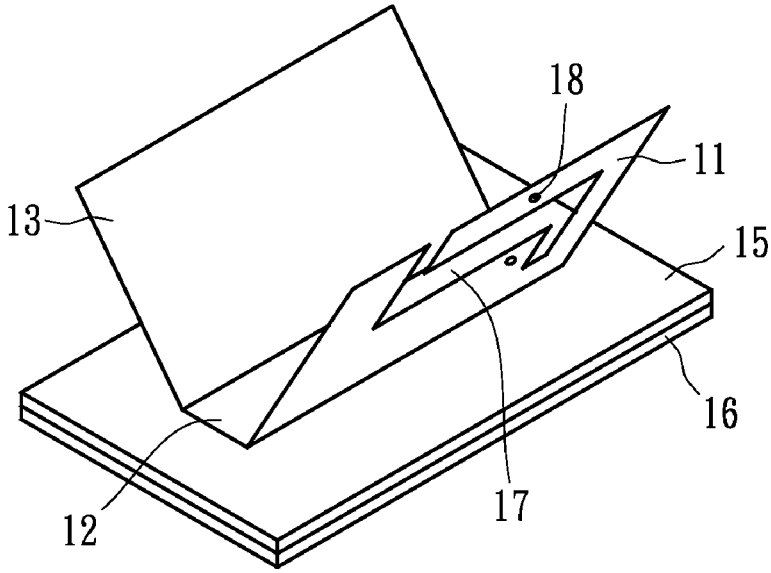

Alternatively, as shown in FIG. 1D, the radiation plate 11 is placed with an angle to the ground plane 15, and the shielding plate 13 is placed with an angle to the ground plane 15.

Preferably, the angle between the radiation 11 and the ground plane 15 is larger than 45 degrees, and the angle between the shielding plate 13 and the ground plane 15 is larger than 45 degrees.

Figure 2:
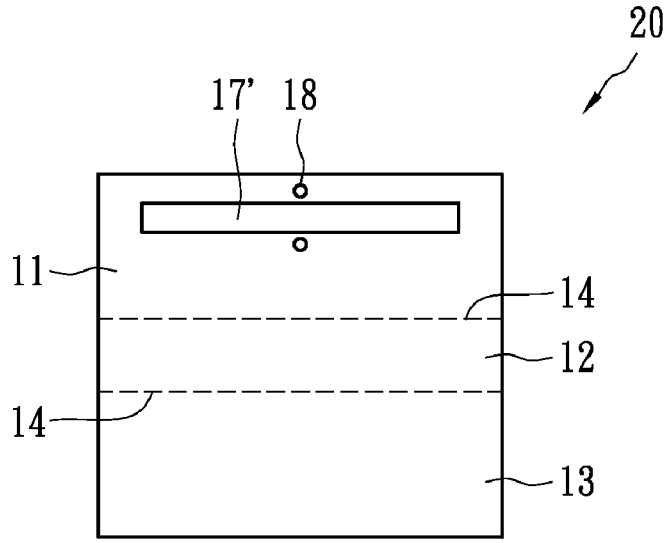
FIGS. 2, 3A, 3B, 4A and 4B show self-shielding antennas in accordance with some embodiments of the present invention.

FIG. 2 shows an antenna 20 in accordance with another embodiment, which is similar to the antenna 10 but has a slot 17' without an opening. The length of the slot 17' is approximately ½ of the length of the radiation electromagnetic wave of the antenna 20.

Figure 3A:
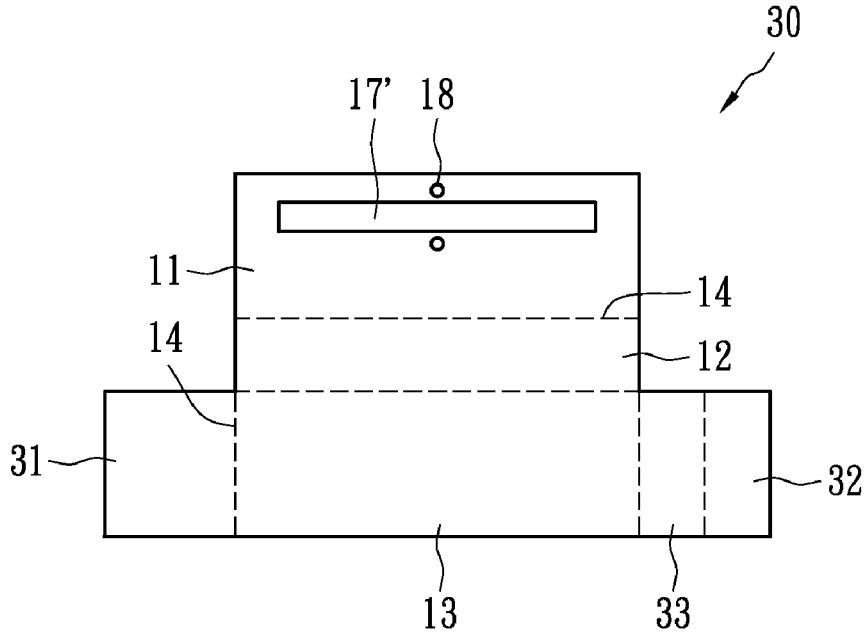
Figure 3B:
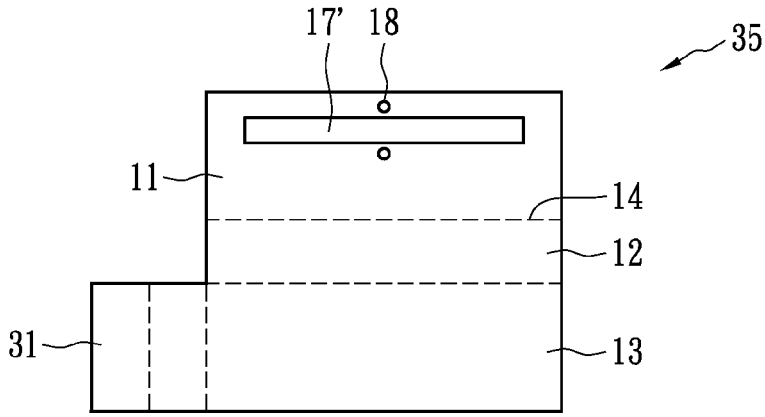

FIGS. 3A and 3B show antennas 30 and 35, respectively. Compared to the antenna 20, the antenna 30 further includes shielding plates 31, 32 and 33 extending from the shielding plate 13 and bending along the folds 14. The shielding plates 31, 32 and 33 could be connected to or perpendicular to the shielding plate 13. Likewise, the shielding plate 12 contacts either the ground plane 15 or the circuit board 16.

Figure 4A:
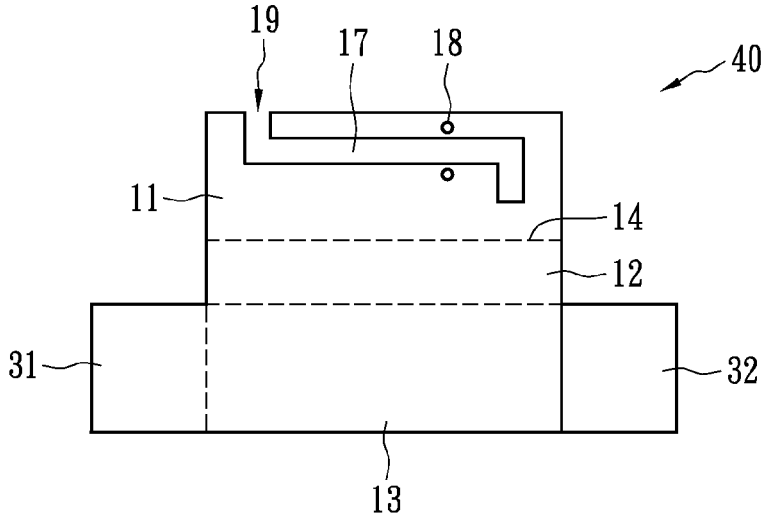
Figure 4B:
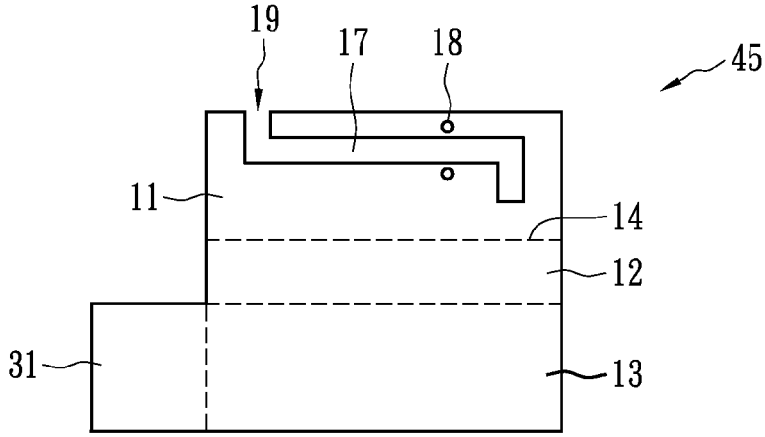

FIGS. 4A and 4B show antennas 40 and 45, respectively. Compared to the antenna 10 shown in FIG. 1A, the antennas 40 and 45 further include shielding plates 31 and/or 32 extending from the shielding plate 13 and bending along the folds 14. Likewise, the shielding plate 12 contacts either the ground plane 15 or the circuit board 16.

Figure 5A:
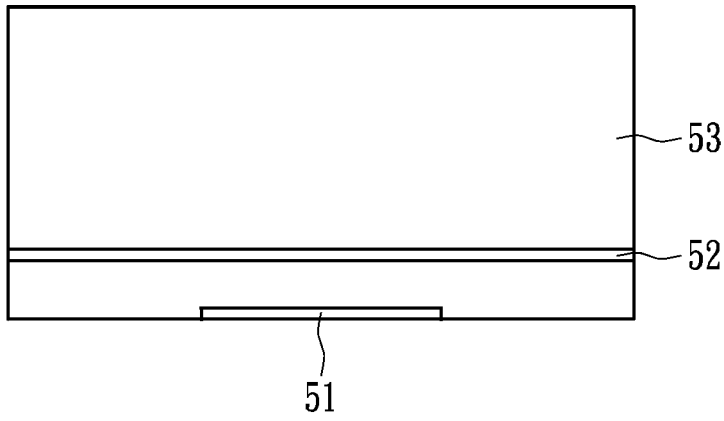
FIGS. 5A to 5I show top views of the arrangements of the antennas and the shielding structures.
Figure 5B:
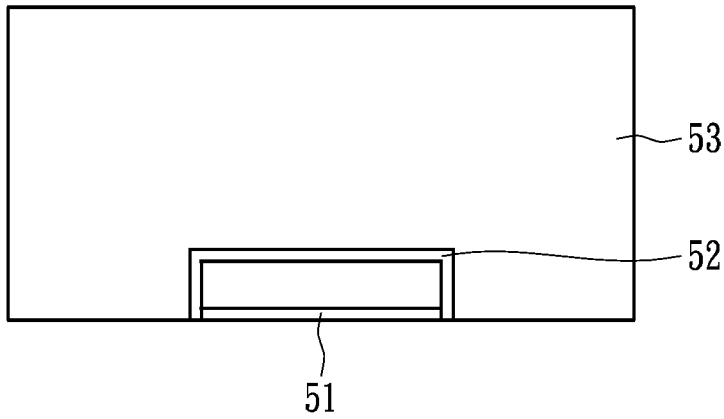
Figure 5C:
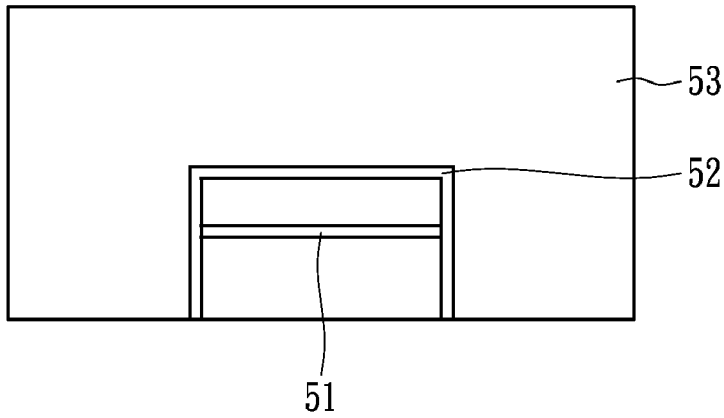
Figure 5D:
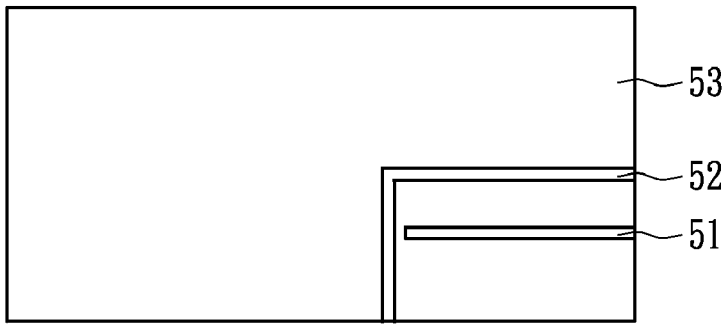
Figure 5E:
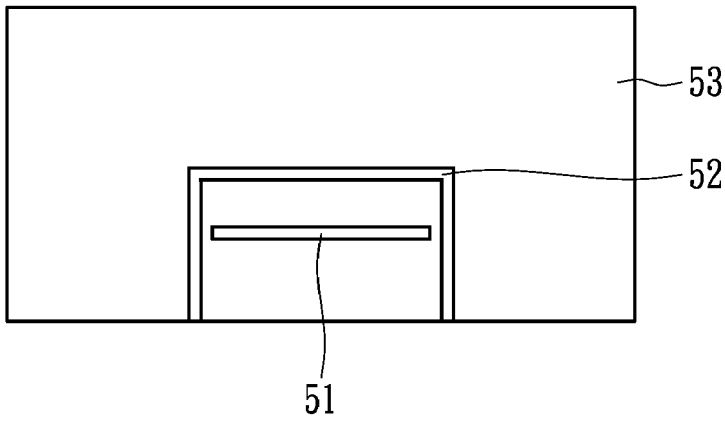
Figure 5F:
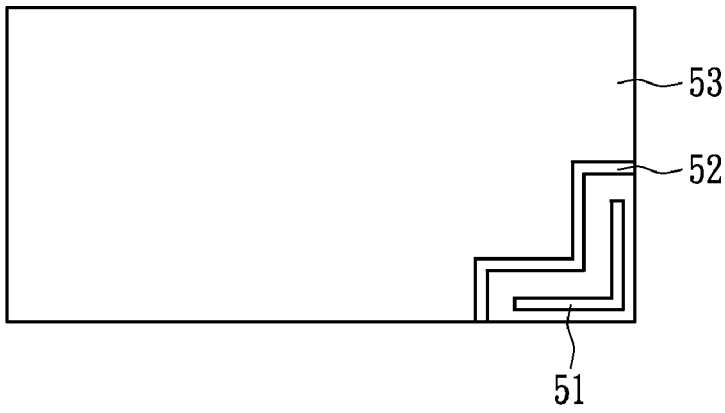

FIGS. 5A to 5F show the top view of the electromagnetic radiation apparatuses according to some embodiments of the present invention. In FIG. 5A, a radiation plate 51 is placed at a side of a ground plane 53, and a shielding plate 52 is placed near the radiation plate 11 and extends to the two sides of the ground plane 53. In FIG. 5B, the radiation plate 51 is placed at a side of the ground plane 53, and the shielding plate 52 encloses the radiation plate 11. In FIG. 5C, the radiation plate 51 is placed in the ground plane 53, and the shielding plate 52 encloses the radiation plate 51. In FIG. 5D, the radiation plate 51 is placed at a corner of the ground plane 53, and the shielding plate 52 encloses the radiation plate 51. In FIG. 5E, the radiation plate 51 is placed in the ground plane 53, and the shielding plate 52 encloses the radiation plate 51. In FIG. 5F, the radiation plate 51 is bent and is placed at a corner of the ground plane 53, and the shielding plate 52 encloses the radiation plate 51 and conforms to the shape of the shielding plate 52.

Figure 5G:
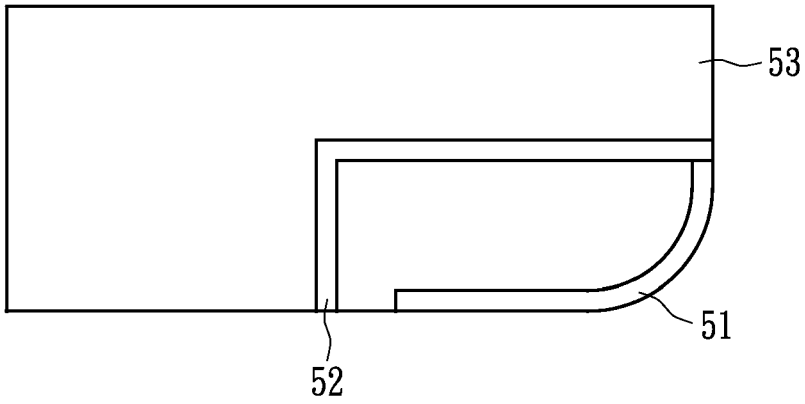
Figure 5H:
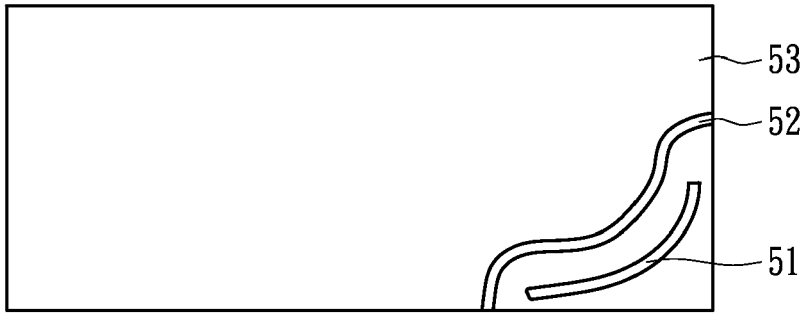
Figure 5I:
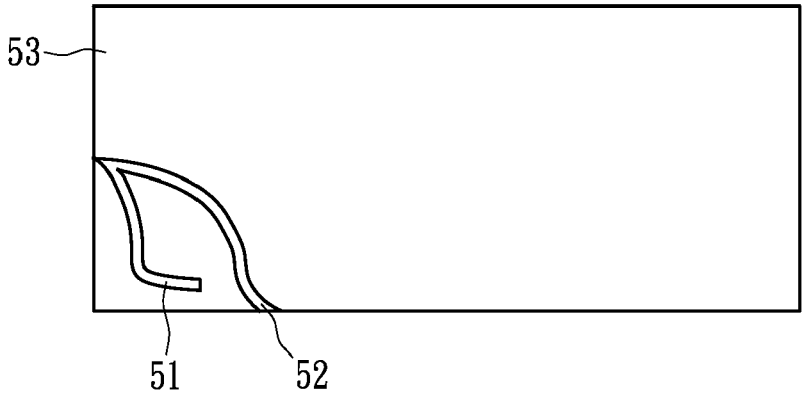

Because radiation apparatus is often placed at a corner of wireless apparatus such as a mobile phone, the radiation plate 51 may be a curved radiation plate to comply with the contour of the mobile phone as shown in FIG. 5G. Moreover, the shielding plate 53 also can be a curved shielding plate that may conform to the shape of the radiation plate 51 as shown in FIG. 5H and FIG. 5I. In FIG. 5H, the radiation plate 51 is not connected to the shielding plate 52. In FIG. 5I, an end of the radiation plate 51 is connected to an end of the shielding plate 52. In practice, two ends of the radiation plate 51 may be connected to two ends of the shielding plate 52.

Figure 6A:
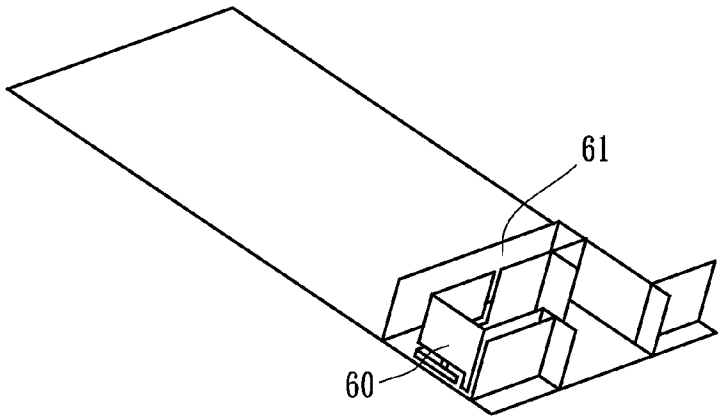
FIGS. 6A to 6D show the electromagnetic radiation apparatuses with and without shielding structures.
Figure 6B:
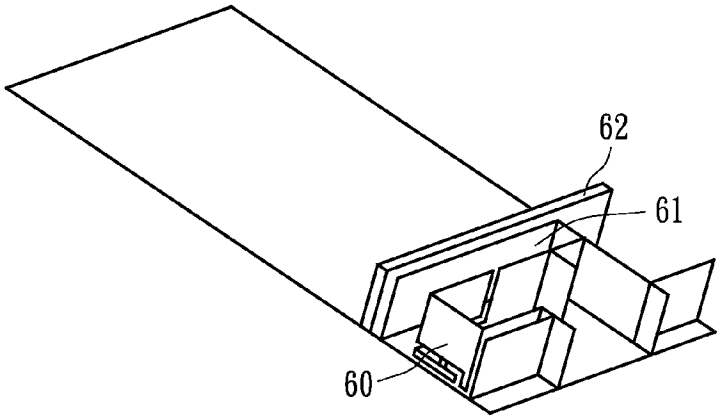
Figure 6C:
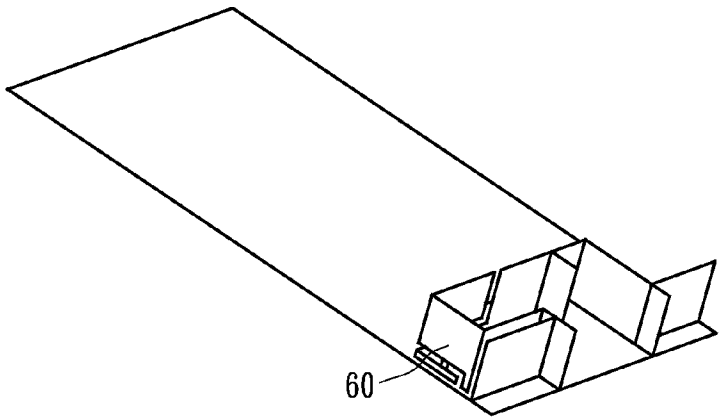
Figure 6D:
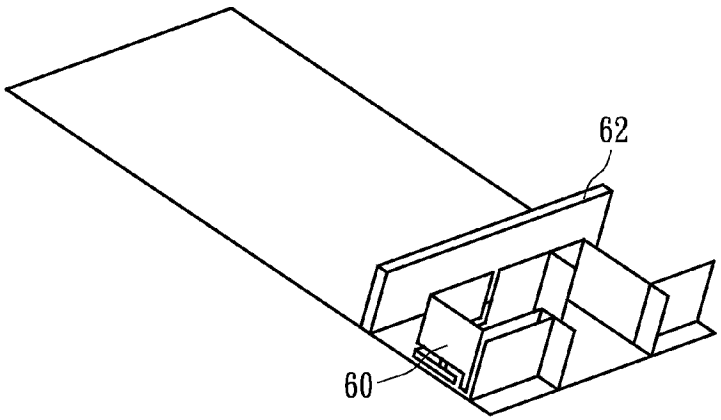

FIG. 6A shows an electromagnetic radiation apparatus having an antenna 60 with a shielding plate 61. The antenna 60 has an open slot. FIG. 6B shows an electromagnetic radiation apparatus having an antenna 60 with a shielding plate 61 and a metal block 62. The metal block 62 is separated from the antenna 60 by 2 mm and serves as a heat dissipation plate, a metal coil or a shell of the electromagnetic radiation apparatus. FIGS. 6C and 6D show antennas 60 without the shielding plate 61 corresponding to FIGS. 6A and 6B. In FIG. 6D, the metal block 62 is separated from the antenna 60 by 5 mm.

Figure 7A:
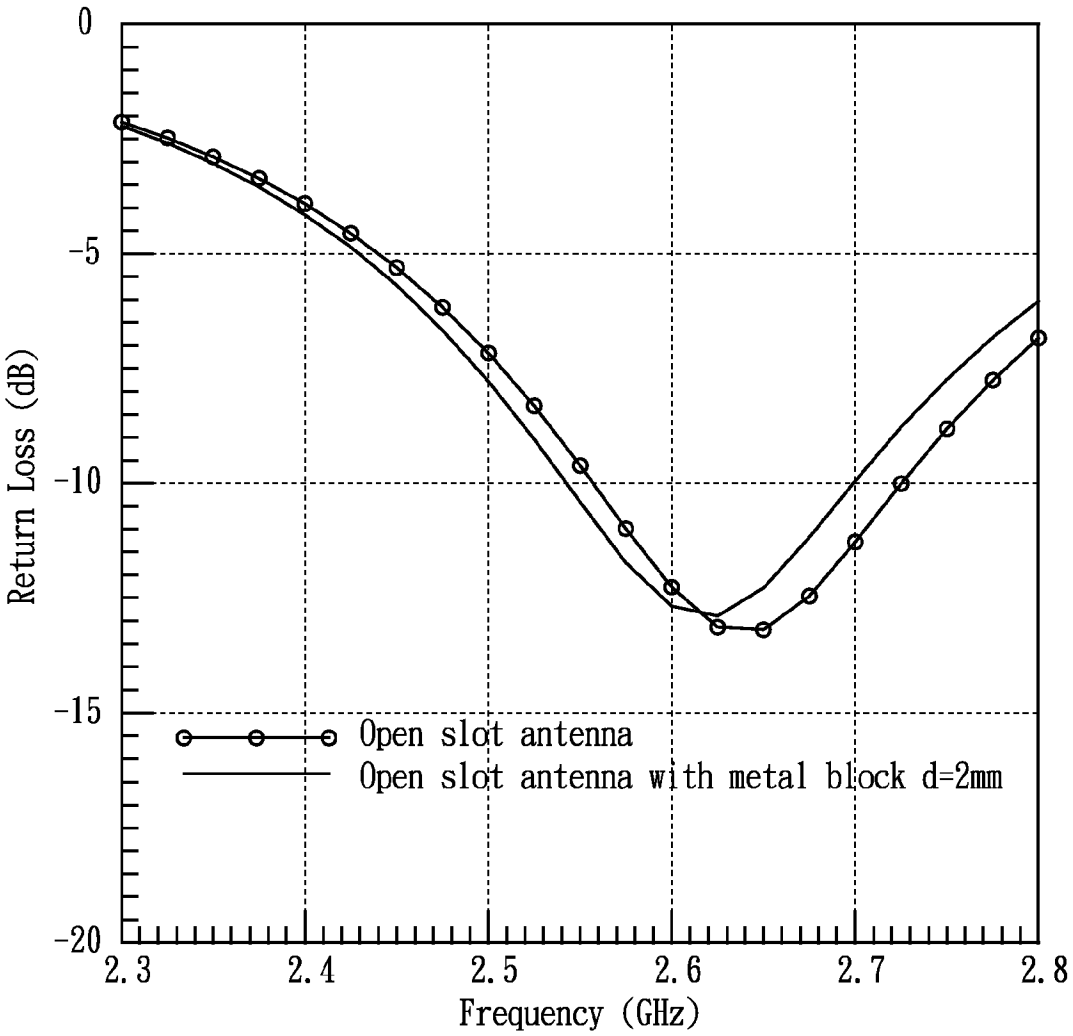
FIGS. 7A, 7B and 8 show return losses and gains of the electromagnetic radiation apparatuses shown in FIGS. 6A to 6D.
Figure 7B:
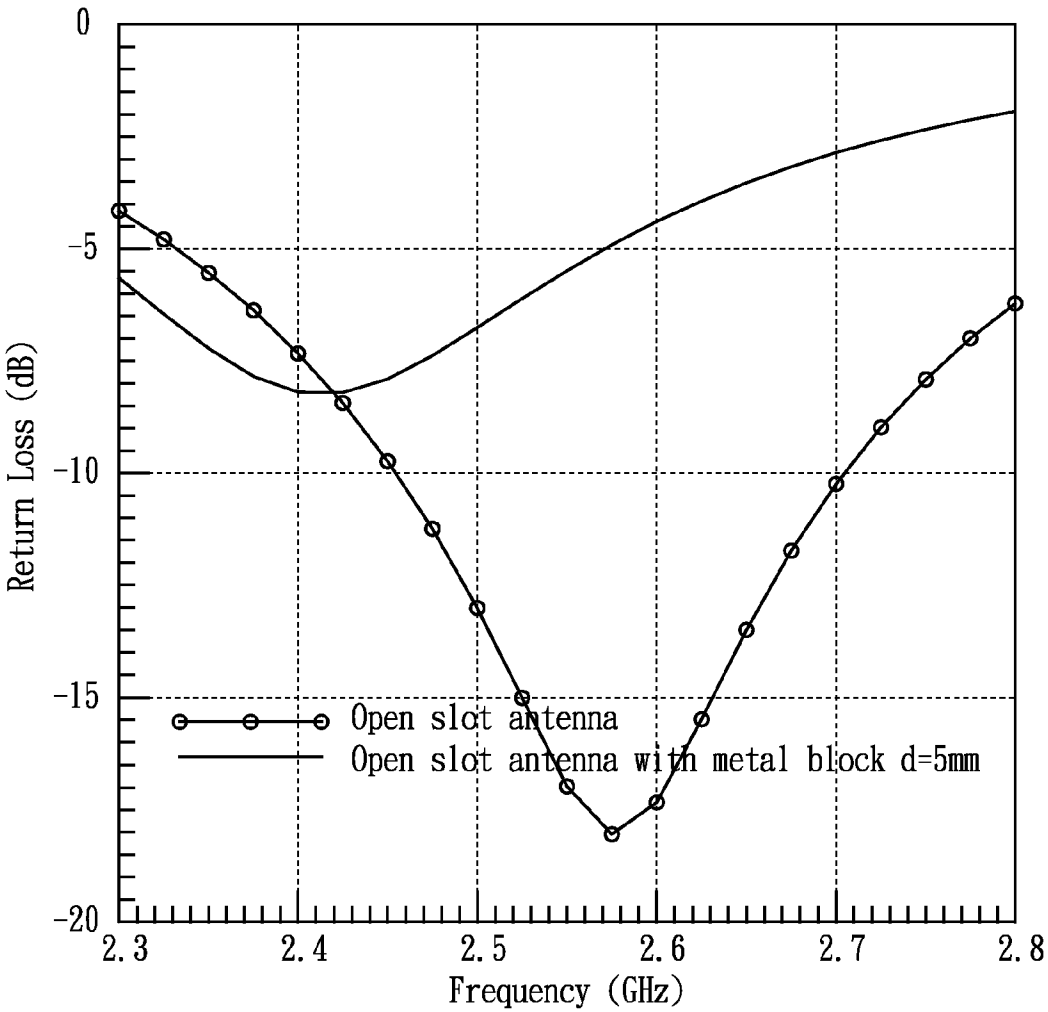

FIG. 7A shows return loss of the electromagnetic radiation apparatuses shown in FIG. 6A and FIG. 6B. The difference of the return losses of the electromagnetic radiation apparatuses with and without a metal block is insignificant. In other words, other elements in the electromagnetic radiation apparatus do not significantly affect the antenna with shielding plate, and vice versa. FIG. 7B shows return loss of the electromagnetic radiation apparatuses shown in FIG. 6C and FIG. 6D. The return loss of the antenna without a shielding plate is decreased by a large amount, i.e. more than 10 dB, and the operating bandwidth is decreased and the return loss is only −7 dB.

Figure 8:
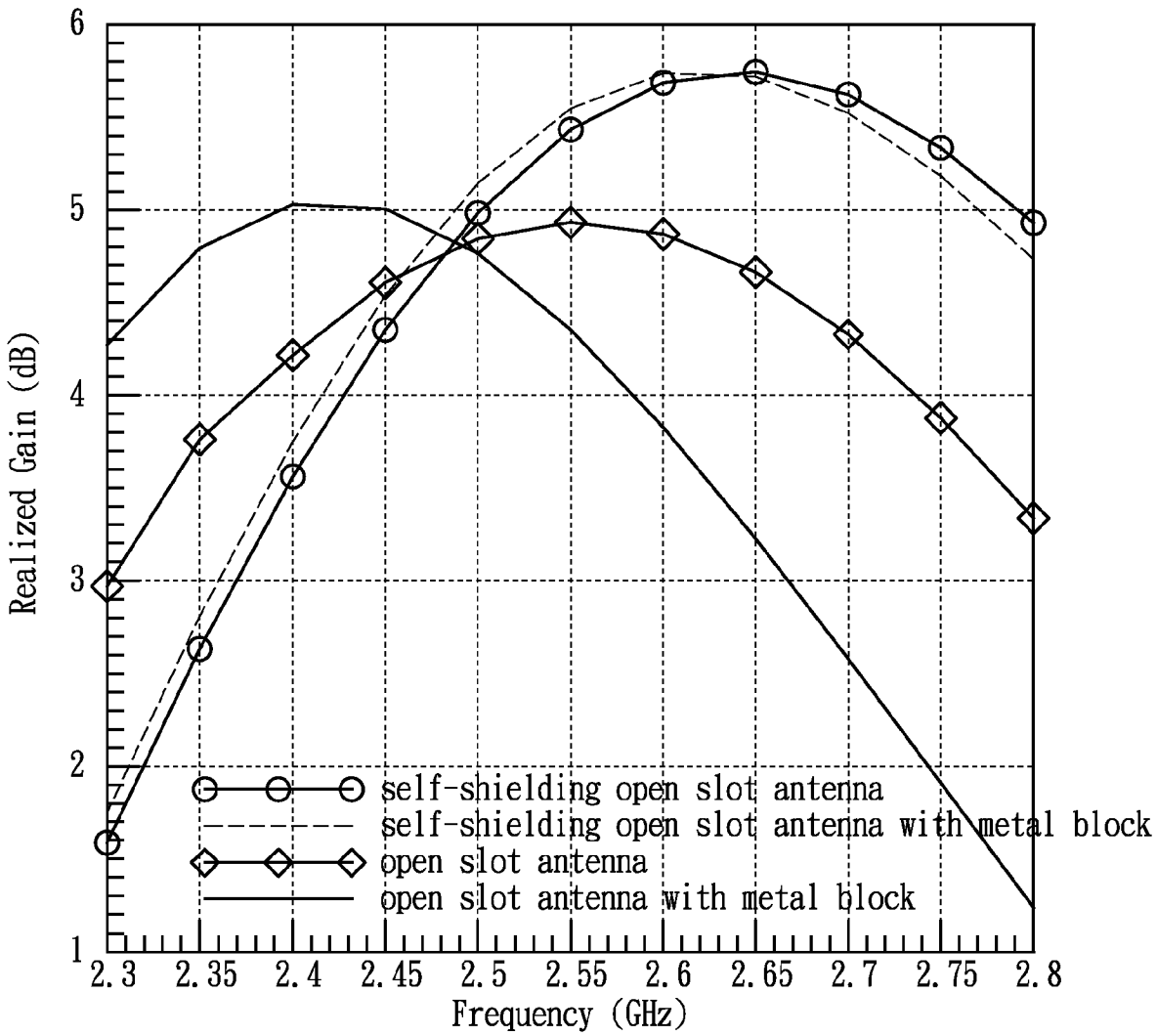

FIG. 8 shows the simulation result of realized gain with reference to the frequency of the electromagnetic radiation apparatuses shown in FIGS. 6A to 6D. The metal block 62 does not affect the characteristic of the antenna 60 with a shielding structure 61, i.e., other elements in the system do not affect the antenna with a shielding structure. When a metal block 62 is placed behind the antenna, as shown in FIG. 6D, the realized gain is only shifted from 2.55 GHz to 2.40 GHz. Therefore, other elements in the electromagnetic radiation apparatus having an antenna without shielding structure would affect the operating bandwidth and the gain significantly.

Figure 9:
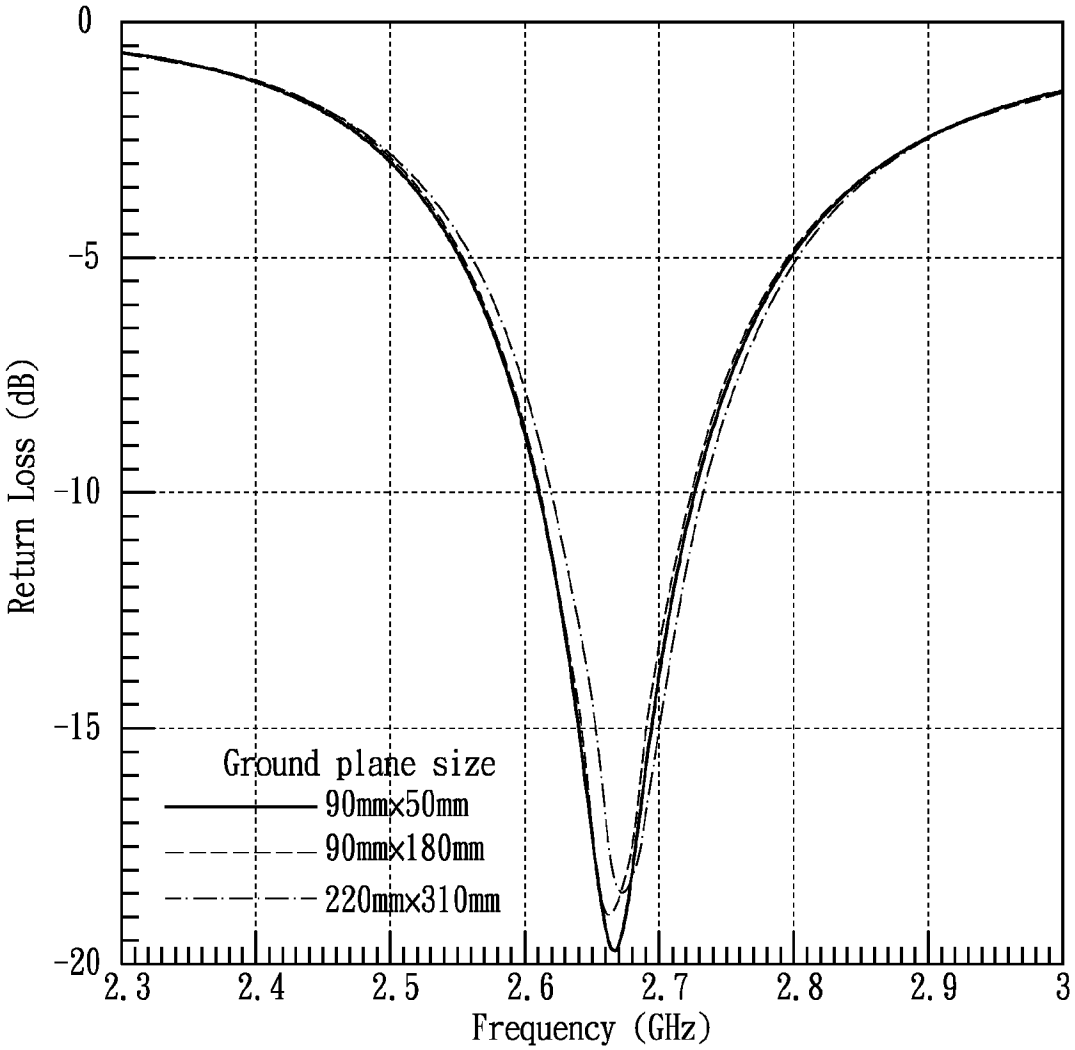
FIG. 9 shows return losses of the electromagnetic radiation apparatuses applied to different electronic devices.

FIG. 9 shows the self-shielding antenna of the present invention in various applications such as a mobile phone including PDAs, a global positioning system (GPS), and a notebook computer. The mobile phone has smaller ground plane size of 90 mm×90 mm, the GPS has a ground plane size of 90 mm×180 mm, and the notebook computer has a ground plane size of 220 mm×310 mm. It can be seen that the return losses of various applications do not change much, so that the self-shielding antenna can be directly applied to electronic apparatuses without further modifications.

Figure 10B:
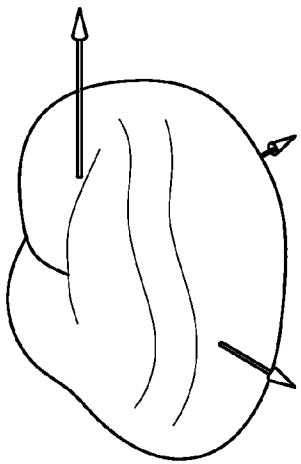
FIGS. 10A to 10H show the electromagnetic radiation apparatuses in accordance with some embodiments of the present inventions and the radiation patterns thereof.
Figure 10D:
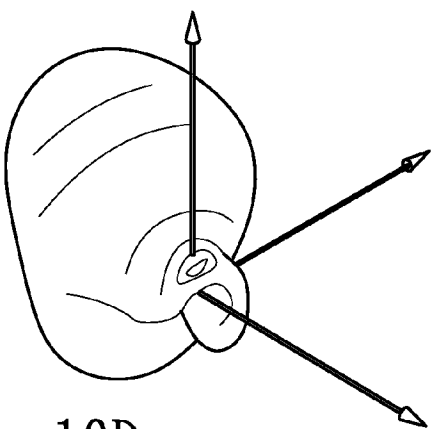
Figure 10A:
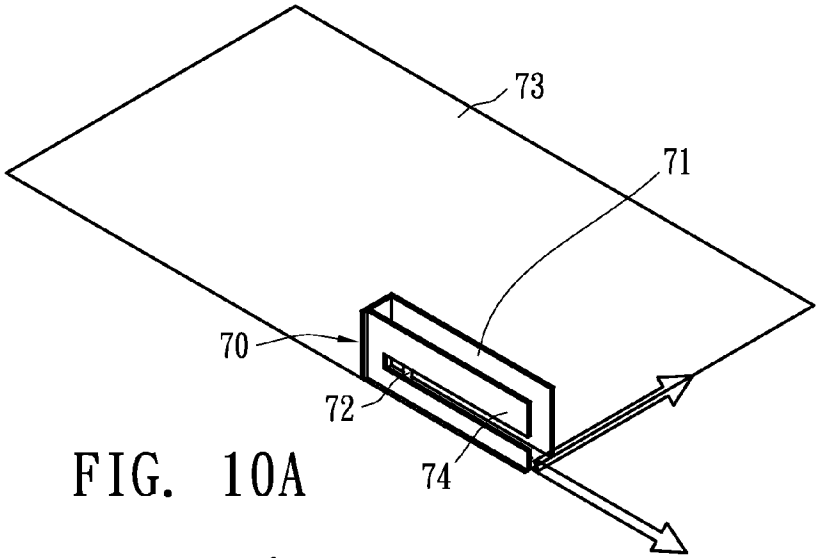
Figure 10C:
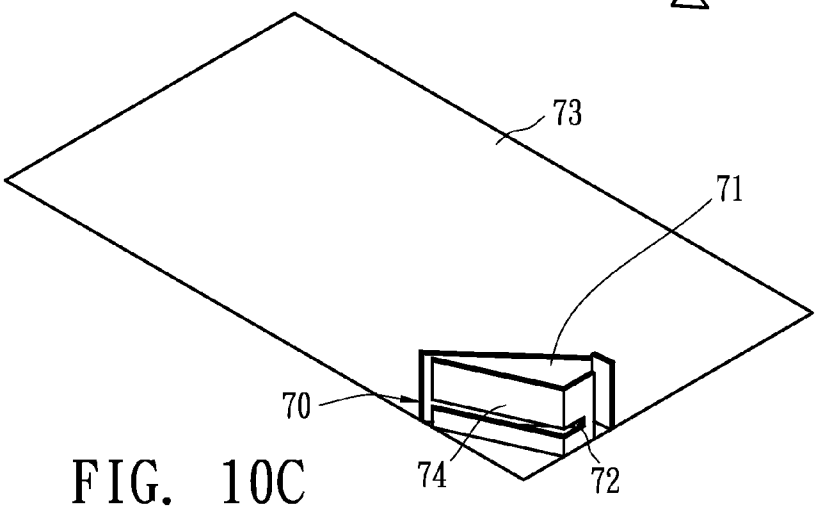
Figure 10F:
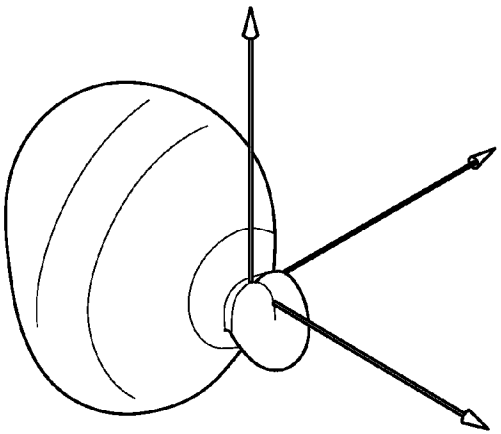
Figure 10H:
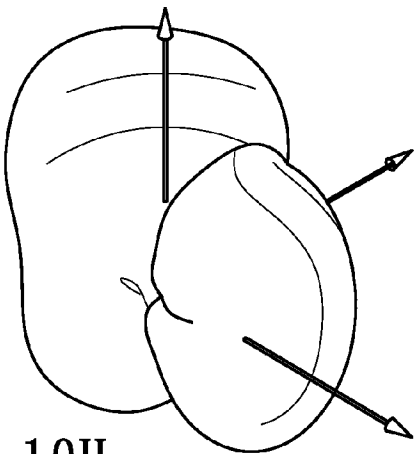
Figure 10E:
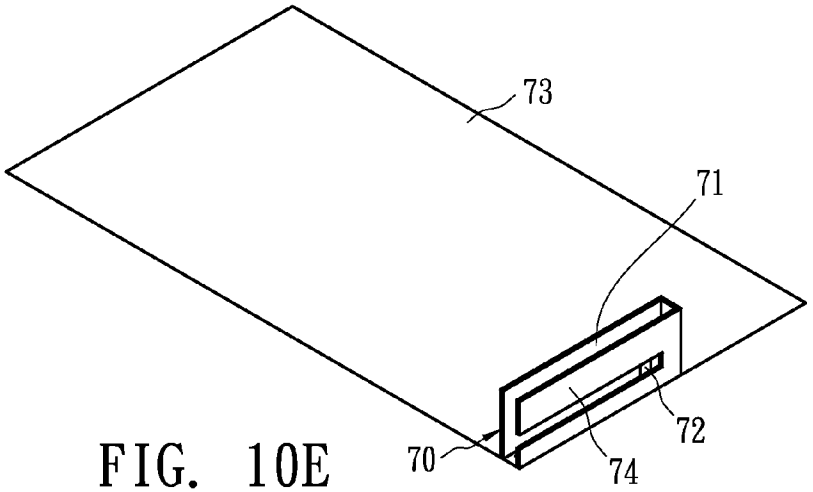
Figure 10G:
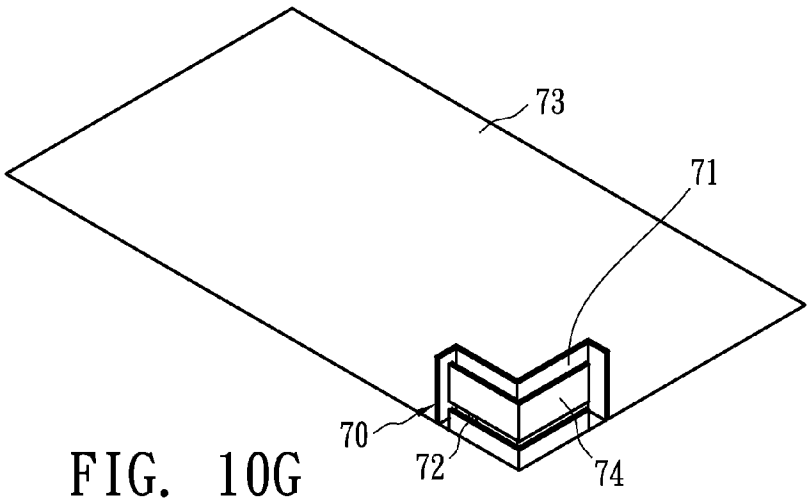

FIGS. 10A to 10B show a shielding antenna of a first embodiment and its radiation pattern. An antenna 70 is placed at a corner of a ground plane 73. The antenna 70 has a shielding plate 71 and a radiation plate 74 with a signal feeding device 72. The radiation plate 74 is parallel to the shielding plate 71. FIGS. 10C to 10D show a shielding antenna of a second embodiment and its radiation pattern. An antenna 70 is placed at a corner of a ground plane 73. The antenna 70 has a radiation plate 74 with a signal feeding device 72 and a shielding plate 71. The shielding plate 74 is bent, and the radiation plate 74 and the shielding plate 71 are not parallel. FIGS. 10E to 10F show a shielding antenna of a third embodiment and its radiation pattern. An antenna 70 is placed at a corner of a ground plane 73. The antenna 70 has a shielding plate 71 and a radiation plate 74 with a signal feeding device 72. The radiation plate 74 is parallel to the shielding plate 71. FIGS. 10G to 10H show a shielding antenna of a fourth embodiment and its radiation pattern. An antenna 70 is placed at a corner of a ground plane 73. The antenna 70 has a shielding plate 71 and a radiation plate 74 with a signal feeding device 72. The radiation plate 74 is bent, and the shielding plate 71 encloses the radiation plate 74. The bending dimensions and the placement of the shielding antenna are changed in different embodiments, and the results show that the radiation patterns are different for the embodiments. The antenna 70 is capable of being bent into different shapes to meet the demand of pattern diversity of multi-input multi-output (MIMO).

Figure 11:
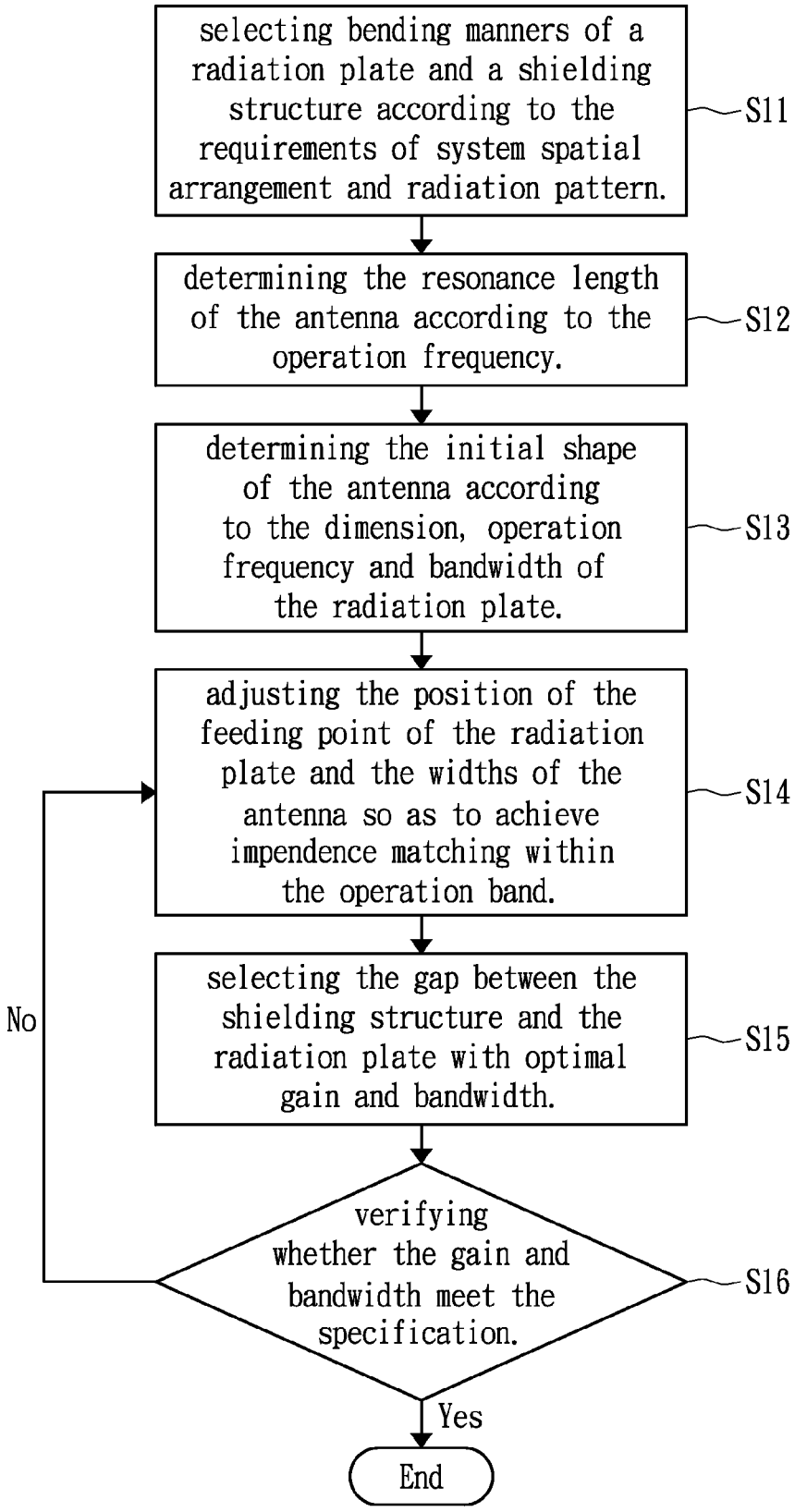
FIG. 11 shows the method for forming the electromagnetic radiation apparatus in accordance with an embodiment of the present invention.

FIG. 11 shows the method for forming the electromagnetic radiation apparatus in accordance with an embodiment of the present invention. In Step S11, selecting bending manners of a radiation plate and a shielding structure according to the requirements of system spatial arrangement and radiation pattern. In Step S12, determining the resonance length of the antenna according to the operation frequency. In Step S13, determining the initial shape of the antenna, e.g., in the form of a straight line, a bending line or a curve, according to the dimension, operation frequency and bandwidth of the radiation plate. In Step S14, adjusting the position of the feeding point of the radiation plate and the widths of the antenna so as to achieve impendence matching within the operation band. In Step 15, selecting the gap between the shielding structure and the radiation plate with optimal gain and bandwidth. In Step 16, verifying whether the gain and bandwidth meet the specification. If so, the design is done, otherwise Step 14 and Step 15 are repeated to form a loop as shown in FIG. 11.

The self-shielding antenna of the present invention can effectively decrease the interference from outside, and vice versa, and can be directly applied to electronic apparatuses without further modifications. Therefore, the antenna with a small size can be easily implemented to mobile phones, GPS, and notebook computers.

The above-described embodiments of the present invention are intended to be illustrative only. Numerous alternative embodiments may be devised by those skilled in the art without departing from the scope of the following claims.

What is claimed is:

1. An electromagnetic radiation apparatus, comprising:

a ground plane; and an integrally formed antenna, comprising:

a radiation plate perpendicular to or with an angle larger than 45 degrees to the ground plane, wherein the radiation plate includes a signal feeding device and a slot, the signal feeding device includes a positive electrode and a negative electrode separated from each other by the slot, the slot extends in a direction substantially perpendicular to the normal direction of the ground plane, and a feeding point of the radiation plate is adjustable to achieve the impendence matching within the operation band; and a shielding structure configured to restrict radiation of the radiation plate.

2. The electromagnetic radiation apparatus of claim 1, wherein the slot has a length of approximately ½ of the length of the electromagnetic wave of the integrally formed antenna.

3. The electromagnetic radiation apparatus of claim 1, wherein the slot has an opening.

4. The electromagnetic radiation apparatus of claim 3, wherein the slot has a length of approximately ¼ of the length of the electromagnetic wave of the integrally formed antenna.

5. The electromagnetic radiation apparatus of claim 1, wherein a longitudinal direction of the slot is parallel to the ground plane.

6. The electromagnetic radiation apparatus of claim 1, wherein the shielding structure comprises a first shielding plate perpendicular to or with an angle larger than 45 degrees to the ground plane.

7. The electromagnetic radiation apparatus of claim 6, wherein the first shielding plate is parallel to the radiation plate.

8. The electromagnetic radiation apparatus of claim 6, wherein the shielding structure further comprises a second shielding plate between and perpendicular to or with an angle larger than 45 degrees to the radiation plate and the first shielding plate.

9. The electromagnetic radiation apparatus of claim 6, wherein the first shielding plate is equal to or larger than the radiation plate.

10. The electromagnetic radiation apparatus of claim 8, wherein the second shielding plate contacts the ground plane.

11. The electromagnetic radiation apparatus of claim 8, further comprising a third shielding plate connected to and perpendicular to the first shielding plate.

12. The electromagnetic radiation apparatus of claim 1, wherein the radiation plate is enclosed by the shielding structure.

13. The electromagnetic radiation apparatus of claim 1, wherein the integrally formed antenna is formed of a plate by bending the plate.

14. The electromagnetic radiation apparatus of claim 1, wherein the radiation plate comprises a curved radiation plate.

15. The electromagnetic radiation apparatus of claim 1, wherein the shielding structure comprises a curved shielding plate.

16. The electromagnetic radiation apparatus of claim 1, wherein the antenna is capable of being bent into different shapes for multi-input multi-output application.

17. The electromagnetic radiation apparatus of claim 1, wherein the antenna is capable of being bent into different shapes to comply with a contour of an electronic apparatus.

18. A method of forming an electromagnetic radiation apparatus having an antenna, the antenna having a radiation plate and a shielding structure, wherein the radiation plate includes a signal feeding device and a slot, the slot extends in a direction substantially perpendicular to the normal direction of the ground plane, and the signal feeding device includes a positive electrode and a negative electrode separated from each other by the slot, the method comprising the steps of:

(a) selecting bending manners of the radiation plate and the shielding structure according to requirements of system spatial arrangement and radiation pattern;

(b) determining a resonance length of the antenna according to operation frequency;

(c) determining an initial shape of the antenna according to dimension, operation frequency and bandwidth of the radiation plate;

(d) adjusting a position of a feeding point of the radiation plate and widths of the antenna so as to achieve impendence matching within operation band; and (e) selecting a gap between the shielding structure and the radiation plate with optimal gain and bandwidth.

19. The method of forming an electromagnetic radiation apparatus of claim 18, further comprising a step of verifying whether the gain and bandwidth meet a specification.

20. The method of forming an electromagnetic radiation apparatus of claim 19, wherein the steps (d) to (e) are repeated if the gain and bandwidth of the antenna do not meet the specification.

* * * * *